US005344065A

United States Patent [19]

Moran

[11] Patent Number: 5,344,065

[45] Date of Patent: Sep. 6, 1994

[54] REVERSIBLE CONTAINERS

[76] Inventor: Charles E. C. Moran, P.O. Box 1166, Charlottesville, Va. 22902-1166

[21] Appl. No.: 119,839

[22] Filed: Sep. 13, 1993

Related U.S. Application Data

[63] Continuation-in-part of Ser. No. 709,424, Jun. 3, 1991, Des. No. 339,438.

[51] Int. Cl.[5] ..... B65D 5/06

[52] U.S. Cl. ..... 229/103; 229/931; 229/242

[58] Field of Search ..... 229/931, 103, 241, 242

[56] References Cited

U.S. PATENT DOCUMENTS

| | | | |
|---|---|---|---|
| D. 30,089 | 1/1899 | Zuck . | |
| D. 232,811 | 9/1974 | Edgeington et al. . | |
| D. 268,649 | 4/1983 | Adamson et al. . | |
| D. 309,050 | 7/1990 | Wolak . | |
| 921,197 | 5/1909 | Zell . | |
| 953,132 | 3/1910 | Fischer . | |
| 2,069,997 | 2/1937 | Carr . | |
| 2,352,766 | 7/1944 | Bogue . | |
| 2,361,852 | 10/1944 | Locke, Jr. . | |
| 2,459,130 | 1/1949 | Jones . | |
| 2,515,327 | 7/1950 | Bergstein . | |
| 2,615,613 | 10/1952 | Reeser . | |
| 2,936,937 | 5/1960 | Guyer | 229/242 X |
| 3,246,825 | 4/1966 | Zastrow | 229/242 X |
| 3,300,115 | 1/1967 | Schauer . | |
| 3,302,857 | 2/1967 | Martin | 229/241 X |
| 3,325,003 | 6/1967 | Bilezerian | 229/242 X |
| 3,721,382 | 3/1973 | Cavanaugh et al. . | |
| 3,952,941 | 4/1976 | Zimmerman . | |
| 4,005,815 | 2/1977 | Nerenberg . | |
| 4,048,052 | 9/1977 | Tolaas . | |
| 4,201,330 | 5/1980 | Gilbert . | |
| 4,388,993 | 6/1983 | Lavery . | |
| 4,482,056 | 11/1984 | Dutcher | 229/241 |
| 4,583,678 | 4/1986 | Weimer, Jr. . | |
| 4,648,548 | 3/1987 | Shin | 229/103 X |
| 4,709,852 | 12/1987 | Stoll | 229/915 X |
| 5,042,714 | 8/1991 | Hall . | |
| 5,119,985 | 6/1992 | Dawson et al. | 229/931 X |

*Primary Examiner*—Allan N. Shoap
*Assistant Examiner*—Christopher McDonald
*Attorney, Agent, or Firm*—Richard C. Litman

[57] ABSTRACT

A reversible container having opposite first and second surfaces may be formed of a single sheet of material. The first surface is folded outward to provide a container e. g., for the shipping, mailing or packing of various articles; provision is made for the disassembly of the container at its destination and for adhesive closure of the everted container for further use with the second surface facing outward, e. g., as a container for recyclable articles. Hand holds and openings in the hinged lid of the container for ease of insertion of articles therein, are also provided; the perforated areas of the lid may be reinforced during shipping by an underlying second sheet, which second sheet is removable at the time of modification to an everted form. The container is preferably formed of recycled corrugated fiberboard material, but may be formed of a variety of other materials such as non-corrugated cardboard or fiberboard, synthetic sheet material, plastics, etc. The everted second surface also provides for decorative patterns, instructions for use, and/or advertising thereon.

15 Claims, 3 Drawing Sheets

REVERSIBLE CONTAINERS

REFERENCE TO RELATED APPLICATION

This application is a continuation-in-part of U.S. design patent application Ser. No. 07/709,424, filed Jun. 3, 1991, issuing as U.S. Des. No. 339,438 on Sep. 14, 1993.

FIELD OF THE INVENTION

The present invention relates generally to packaging and storage containers, and more specifically to a container or containers preferably formed of recyclable materials and usable for the shipping, mailing or packing of various articles, which containers are specially formed to be reversible to expose a second unmarked or decorated side and used as containers for recyclable items.

With ever increasing population pressures and a materialistic society, the recycling of all kinds of articles has become increasingly popular, even to the extent that manufacturers developed specialized containers for such recycling (e. g., divided for cans, papers, bottles, etc.). However, many of these recycling containers are made from new materials, and while for the most part they are relatively durable, the materials from which they are formed tends to defeat the purpose of the concept of recycling, at least to some extent.

At the same time, the use of mail order shopping has become more popular, as specialized interests develop among shoppers and as it becomes more and more costly for stores to maintain complete stocks of merchandise in all available sizes, colors, styles, etc. to satisfy the needs of consumers. Typically, such mail orders shipped in a conveniently sized disposable container, which in the case of bulky articles, may mean the discarding of a container which might otherwise be put to good use.

Accordingly, the need arises for a shipping or mailing container specially formed to be adaptable as a functional and attractive container for recyclable articles. The container may be used for the shipping, mailing or packing and storage of an article or articles, with shipping labels and other markings as required placed on the outer or first surface of the container. When recipient opens the container, the outer and inner surfaces may be reversed by means of the specialized construction of the container, thereby exposing an unmarked or decorative second surface. Additional perforated or prepunched areas may be provided to allow for ease of opening and folding by the recipient for conversion to a recycling container. The container is preferably formed of corrugated cardboard material (which may be formed of recycled paper products), but other materials may be used as required or as desired.

DESCRIPTION OF THE PRIOR ART

U.S. Pat. No. 921,197 issued to Harvey Zell on May 11, 1909 discloses a Paper Box formed of a single sheet of material. No specific means for reversal is disclosed, nor are any openings provided.

U.S. Pat. No. 953,132 issued to Frederick G. Fischer on Mar. 29, 1910 discloses a Folding Box formed from a single sheet of material and having a front opening. No pre-punched perforations are provided for removing portions of the lid (or any other area) in order to provide an opening for the insertion of articles, nor is any means provided for reversibly folding and securing the box in order to expose an unmarked or decorative surface for a secondary use, such as a recycling container.

U.S. Pat. No. 2,069,997 issued to Edward J. Cart on Feb. 9, 1937 discloses a Carton formed of a single sheet of material and including upper hand holds and interior partitions. The interior partitions and asymmetric nature of the blank preclude reversibility of the device.

U.S. Pat. No. 2,352,766 issued to Walter H. Bogue on Jul. 4, 1944 discloses a Paper Box formed of a plurality of panels. While an upper opening is disclosed, the construction requires a plurality of sheets of material and does not lend itself to reversibility.

U.S. Pat. No. 2,361,852 issued to Edwin A. Locke, Jr. on Oct. 31, 1944 discloses a Blade Container formed of two sheets of material and having two separate compartments. While a slot is provided in the top, the structure does not provide for reversibility, as in the present invention.

U.S. Pat. No. 2,459,130 issued to John P. Jones on Jan. 11, 1949 discloses a Cream Dispenser disclosing a specialized dispensing spout. No other specific construction is disclosed.

U.S. Pat. No. 2,515,327 issued to Samuel Bergstein on Jul. 18, 1950 discloses a Method Of Making Knockdown, Hinged Lid Cartons. The construction requires a separate piece of material to close the bottom of the carton, and no means is provided for reversibility nor openings in the lid for the insertion of articles therein.

U.S. Pat. No. 2,615,613 issued to Harry C. Reefer on Oct. 28, 1952 discloses a Container With Telescoping Closure formed of two separate sheets of material. The container cannot be reversed or everted, due to the relationship of the hand holds and other features.

U.S. Pat. No. 3,300,115 issued to Marvin L. Schauer Jan. 24, 1967 discloses a Compartmented Dispensing Carton Formed From A Single Blank. The partitioned nature of the interior, combination with the handle and remaining structure, preclude the reversibility of the container.

U.S. Pat. No. 3,721,382 issued to Ronald P. Cavanaugh et al. on Mar. 20, 1973 discloses Dispensing Packages for wire and the like and having a corner knock out to provide a handle for carrying the container. No means for reversibility is provided.

U.S. Pat. No. 3,952,941 issued to John Zimmerman on Apr. 27, 1976 discloses a Bottom Locking Carton formed of a single sheet of material and including additional panels extending upward from the bottom to form partitions within the completed carton. In consideration of the internal partitions, no means for reversing the structure is seen, and the internal partitions preclude suitability as a recycling container.

U.S. Pat. No. 4,005,815 issued to Robert W. Nerenberg et el. on Feb. 1, 1977 discloses a Carton With Self-Contained Reinforced Handle which uses a portion of the lid edge or side wall extension as an additional thickness in the handle area for greater strength. No means is disclosed for reversing the structure, nor is any means disclosed for providing lid openings.

U.S. Pat. No. 4,048,052 issued to William M. Tolaas on Sep. 13, 1977 discloses a Recloseable Carton formed of a single sheet of material and including multiple layers of material at the hinged lid area providing for sealing and locking of the lid to the remainder of the box.

No means for reversal or everting of the structure is disclosed, nor is any means for providing slotted or other openings for the insertion of articles into the closed lid of the box.

U.S. Pat. No. 4,201,330 issued to Earl F. Gilbert on May 6, 1980 discloses a Hinged Cover Container With Hand Hole Lock. The box is formed of a single sheet of material and includes a hinged lid, but no means is disclosed for the reversal of the structure, due to the hand hold cutouts of the lid which engage slots in the box sides. A slot is provided in the top of the lid, but the provided slot precludes sealing of the contents, unlike the container of the present invention.

U.S. Pat. No. 4,388,993 issued to John J. Lavery on Jun. 21, 1983 discloses a Multiple Access Carton formed of a single sheet of material and having a lid. No other openings are disclosed in the lid, nor is any means disclosed for reversing or everting the container for further use.

U.S. Pat. No. 4,583,678 issued to Charles P. Weimer, Jr. Apr. 22, 1986 discloses a Bottom Speed Lock For Container formed of a single sheet of material. No reversal of the structure noir performed upper openings are disclosed.

U.S. Pat. No. 5,042,714 issued to John B. Hall on Aug. 27, 1991 discloses a Collapsible Grocery Container having interlocking bottom closure means. No top closure or reversible structure is disclosed.

U.S. Pat. No. Des. 30,089 issued to William B. Zuck on Jan. 31, 1899 discloses a design for a Box. An elliptical side opening is provided, but no further structure is evident to permit construction of the device from a single sheet of material or provide for reversing the box.

U.S. Pat. No. Des. 232,811 issued to James N. Edgeington et al. on Sep. 17, 1984 discloses a Carton having plural side openings and an inset bottom. No opening in the lid or reversal means is disclosed.

U.S. Pat. No. Des. 268,649 issued to Gerhard Adamson et el. Apr. 19, 1983 discloses a Packaging Container having a removable upper and side portion. No means for reversal of the container is disclosed.

Finally, U.S. Pat. No. Des. 309,050 issued to Ronald G. Wolak on Jul. 3, 1990 discloses a Disposable Animal Litter Container having a pleated, accordion-like plurality of folds in three of the sides. The fourth side provides a hinge for the expansion of the container. The structure illustrated precludes reversibility of the device.

None of the above noted patents, taken either singly or combination, are seen to disclose the specific arrangement concepts disclosed by the present invention.

SUMMARY OF THE INVENTION

By the present invention, an improved container providing for the everting or reversibility of the container, is disclosed.

Accordingly, one of the objects of the present invention is to provide an improved container which includes first and second sealing means, which first sealing means may be separated to open the container and which second sealing means may be used to close the everted container for reuse.

Another of the objects of the present invention is to provide an improved container which may be formed from a single sheet of material.

Yet another of the objects of the present invention is to provide an improved container which is preferably formed of corrugated fiberboard material, but which may alternatively be formed of a wide variety of other sheet materials, such as non-corrugated fiberboard or cardboard, synthetic materials, plastics, etc.

Still another of the objects of the present invention is to provide an improved container which includes a hinged lid and removable material providing openings in the lid for the insertion of articles into the container.

A further object of the present invention is to provide improved container which may include a removable secondary panel disposed beneath the lid in order to preclude the inadvertent removal of the removable material in the lid.

An additional object of the present invention is to provide an improved container which first surface provides means for shipping, mailing and/or content information thereon, and which opposite second surface provides means for the placement of decorative markings, advertising, instructions and/or other indicia thereon.

A final object of the present invention is to provide an improved container for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 2:
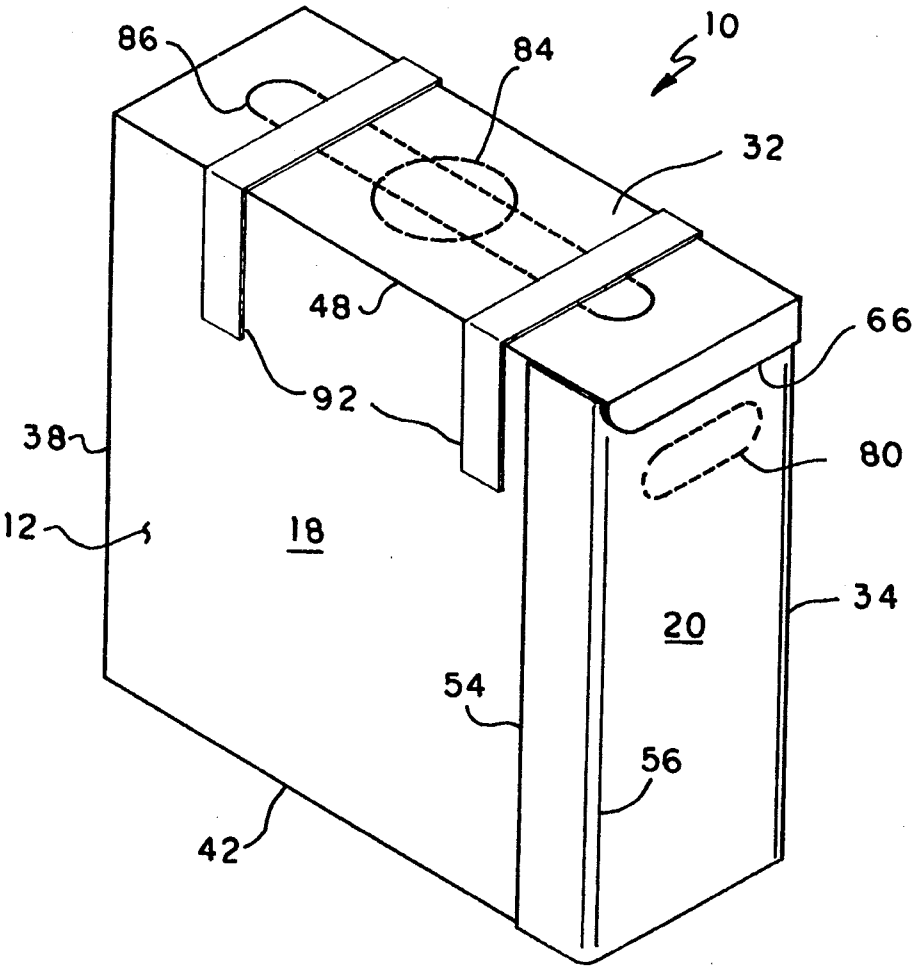
FIG. 2 is a perspective view of the container of the present invention in its first state, showing various details.
Figure 3:
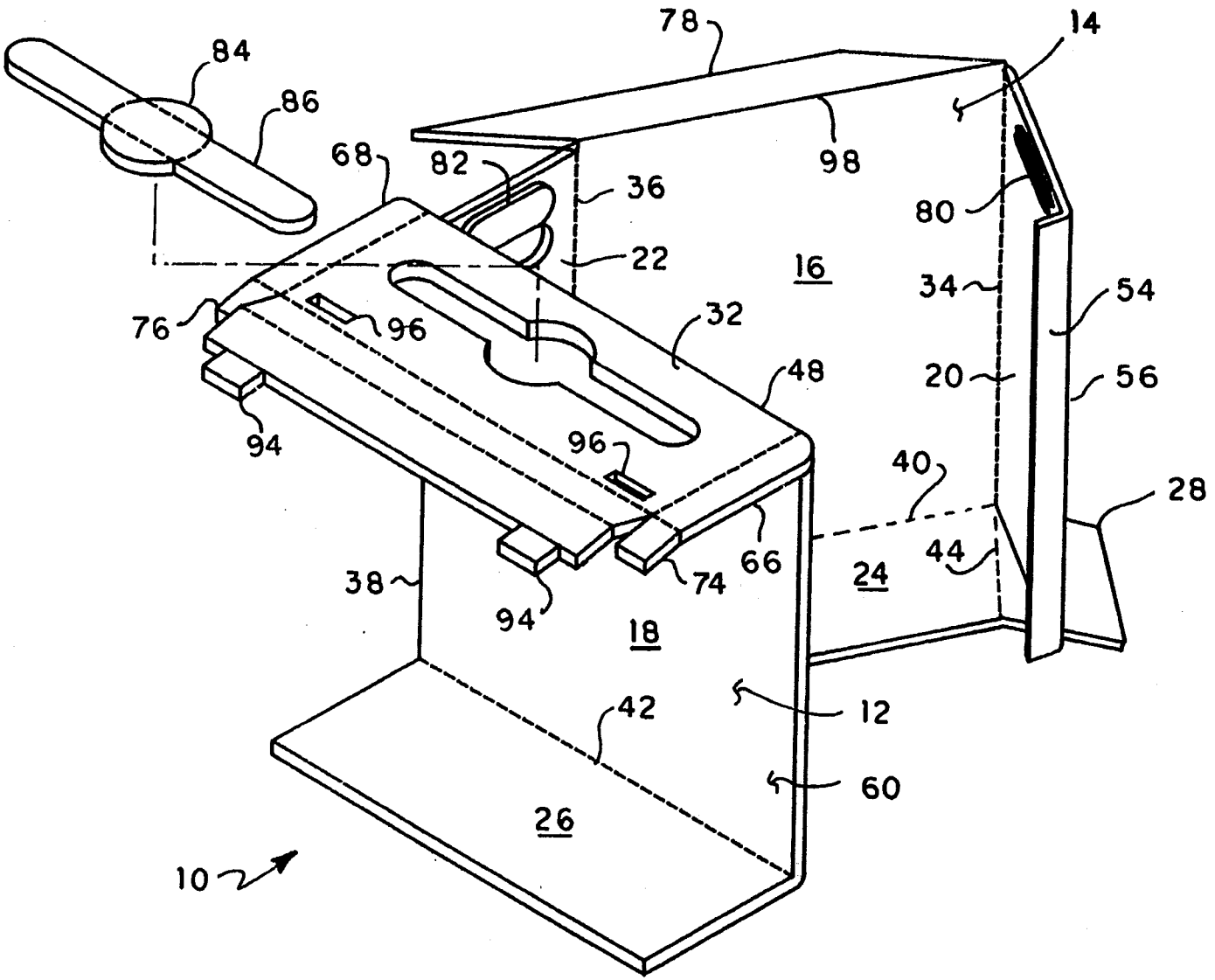
FIG. 3 is a perspective view of the container in a folded state, showing the everting thereof with the second side outward.

Referring now particularly to FIGS. 2 and 3 of the drawings, the present invention will be seen to relate to a container 10 which can be everted from a first state with a first surface 12 outward and the second surface 14 inward, to a second state with the first surface 12 inward and the second surface 14 outward. The container 10 is preferably formed of recycled material, such as a corrugated cardboard or fiberboard material made from recycled paper products, although other materials (e. g., single layer cardboard or fiberboard, synthetics and/or plastics, composites, etc., either virgin or recycled) may be used. While the first surface 12 need not be finished to any particular standard degree, being intended as an outer surface for a shipping container as explained further below, the second surface 14 is preferably provided with a finish which may be imprinted with an attractive designs(s), advertising, assembly instructions, etc., as the second surface 14 is intended to be displayed after the container 10 is first used as a shipping container.

Figure 1A:
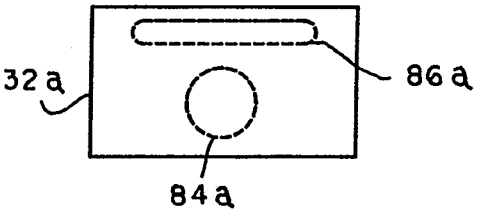
FIG. 1A is a top plan view of an alternative pattern providing for openings in the lid of the container.
Figure 1B:
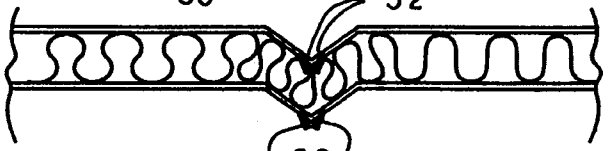
FIG. 1B is a cross sectional view of the corrugated material of which the container is preferably formed, showing the scoring and perforation of the material to provide for bending and folding of the material.
Figure 1C:
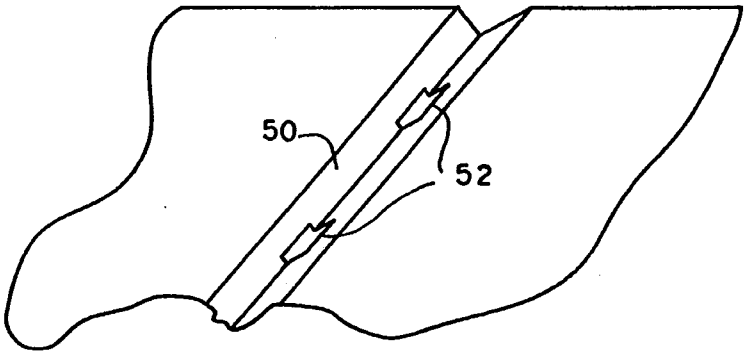
FIG. 1C is a perspective view of the scoring and perforations of FIG. 1B.
Figure 1:
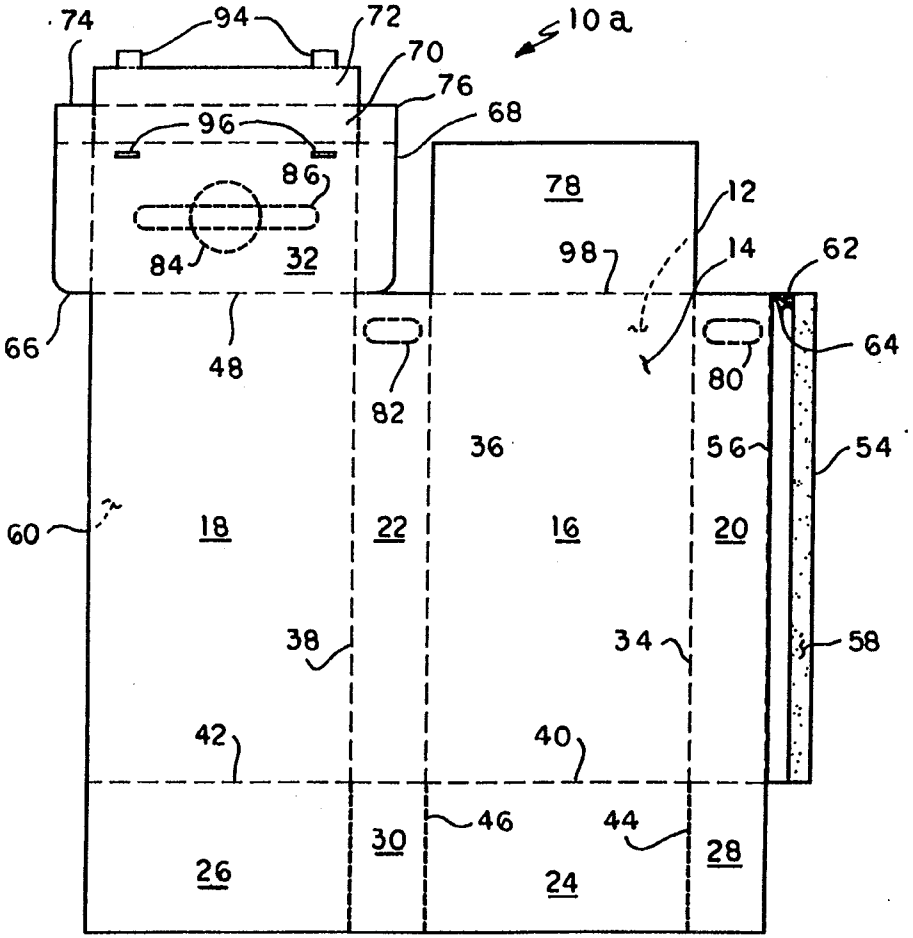
FIG. 1 is a plan view of the flat pattern from which the container of the present invention is formed.

Container 10 is preferably formed from a flat pattern, single sheet 10*a*, as shown in FIG. 1; the sides and areas of the container pattern 10*a* described immediately below will be seen to be applicable to the container 10 of FIGS. 2 and 3 also. In FIG. 1, the container pattern or blank 10*a* is shown with the second side 14 disclosed, in order to disclose fully certain features to be described below. Container 10 and container blank 10*a* each include a front panel 16, a rear panel 18, and first and second side panels 20 and 22. Additional front bottom panel, rear bottom panel, and first and second front bottom panel extensions 24 through 30 provide bottom closure means for the container 10 of the present invention, while a top or lid panel 32 provides top closure means.

Fold lines 34 through 48 respectively provide for folding the edges between the front panel 16 and the first side panel 20; front panel 16 and second side panel 22; rear panel 18 and second side panel 22; front panel 16 and front bottom panel 24; rear panel 18 and rear bottom panel 267 front bottom panel 24 and first front bottom panel extension 28; front bottom panel 24 and second front bottom panel extension 30; and rear panel 18 and top or lid panel 32. Each of these fold lines is represented by a dashed line on the pattern 10*a* of FIG. 1, and are shown as the various folded edges in the appropriate views of FIGS. 2 and 3.

FIGS. 1B and 1C disclose detail views of one means for accomplishing the above and other folds with the present invention. FIG. 1C discloses a typical fold line on a panel used in the container of the present invention, which fold line has been produced by forming a continuous score or crease 50 along the desired line and further providing a series of intermittent perforations 52 to provide for further ease of bending along the score or crease 50. FIG. 1B provides a cross sectional view of the score or crease 50 and a perforation 52 of FIG. 1C. While the intermittent perforations 52 are shown along the score or crease 50, it will be understood that the perforations 52 may be eliminated if desired or required for certain containers.

The container 10 of the present invention provides for assembly by means of an adhesive tab 54 extending from the edge 56 of the first side panel 20 opposite that of the front panel/first side panel fold 34, and extending along the entire length of the side panel 20. Adhesive tab 54 is provided with an adhesive material 58 (indicated by the stippling of FIG. 1) on its second surface side 14 at the time of manufacture or assembly, which is used to adhesively secure the tab 54 to the first surface 12 along the opposite edge 60 of the rear panel 18 during assembly, as will be explained in detail further below. A second, generally parallel adhesive strip 62 is also provided adjacent the first adhesive material 58, but is protected by a removable covering or release sheet 64 until needed for later use, as will be explained below.

The lid or top panel 32 also includes a depending edge therearound when folded, by means of first and second lid side edges 66 and 68, first and second lid front edge portions 70 and 72, and first and second corner tabs 74 and 76. When the container 10 of the present invention is first assembled with its first surface 12 as the outer surface, a secondary inner lid panel 78, which panel 78 extends from the upper edge of the front panel 16, is also provided in order to provide additional security, as will be explained further below.

The container 10 of the present invention also includes hand hold or handle panels 80 and 82 provided in the upper areas of the sides 20 and 22, and circular and slotted panels 84 and 86 in the lid 32. These various panels 80 through 86 are preferably perforated during the manufacture of the present container blank 10*a*, and may easily be folded inwardly (in the case of the hand hold panels 80 and 82) or punched out as desired for later access to provide these various openings. While FIGS. 1, 2 and 3 show the panels 84 and 86 as being mutually concentric, it will be understood that this need not necessarily be the case, and that panels/openings 84 and 86 may be separated, as shown in the alternate embodiment of lid 32*a* and panels/openings 84*a* and 86*a* of FIG. 1A.

A container 10 is formed from a blank 10*a* by first folding the rear bottom panel 26 and the first and second front bottom panel extensions 28 and 30, 90 degrees upward from the flat positions shown in FIG. 1. The front, rear and side panels 16 through 22 are then folded upward along lines 34 through 38, to close the generally rectangular structure thereby provided. The rear bottom panel 26 is simultaneously placed above the front bottom panel 24, with the first and second front bottom panel extensions 28 and extending upward respectively along the first and second side panels 20 and 22, and captured within the resulting box structurize by the adjacent front and rear panels 16 and 18. Thus, once the above folding is accomplished and the first adhesive strip 58 along the adhesive tab 54 is secured to the opposite edge 60 of the rear panel 18, the bottom structure of the box needs no adhesive as it is mechanically locked in place by the two front bottom panel extensions 28 and 30.

The lid 32 and edges 66 through 72 are assembled by folding the two tabs 74, 76 upward 90 degrees, and then folding the first and second front edges 70, 72 over, with the second front edge 72 being doubled over the two tabs 74, 76 to capture them and preclude the unfolding of the two edges 66, 68 from which they extend, somewhat in the manner of the locking of the two front bottom panel extensions 28 and 30 within the assembled container 10 as described above. Tabs 94 extending from the edge of the secondary front edge 72 may be inserted into the front slots 96 of the lid 32. In addition, an optional lid secondary inner panel 78 may be provided, which secondary panel extends from the upper edge 98 of the front panel 16 and is folded back under the lid or top panel 32 to lime parallel and immediately adjacent thereto. This secondary inner panel 78 serves to prevent the premature punching out or removal the two access panels 84 and 86 from the top or lid 32, thus precluding removal of the contents of an assembled container 10 before delivery.

The completed container 10 will be seen to require only a single adhesively secured edge., with all other edges, seams and structure being locked together by means of the specific structure provided. The resulting container 10 may then be packed as desired or required, and the lid 32 folded over along the fold line 48, and with the edges 66 through 72 depending therefrom to provide positive closure of the container 10. The lid 32 may be further sealed using tape 92 or other suitable means, as shown in FIG. 2, and a mailing or shipping label provided as needed.

When the container 10 arrives at its destination and the contents thereof are removed, the container 10 may be easily opened and everted for further use. Any tape 92 or other means used seal the lid 32 in a closed state may be removed or cut, and the lid 32 disassembled to a flat state by removing the tabs 94 of the second front edge 72 from the front lid slots 96 and unfolding the various lid and lid edge components 32, and 66 through 76. The inner secondary lid panel 78, if provided, is removed or folded down along the separation line 98 at the upper edge of the front panel 16 at this time. The various edge panels 66 through 76 are then everted or folded in the reverse pattern of that used to form the shipping container 10 described above, to place the second surface 14 to the outside of the lid 32. The perforated areas and 86 (or alternatively 84*a* and 86*a* of lid 32*a*) may be removed provide access openings to the interior of the container when reassembled. The perforated areas 80 and 82 respectively of the upper first and second side panels 20 and 22 may be folded inwardly to provide hand hold openings for the completed everted container 10, if desired. The use of the upper edge as the hinge or fold line for the hand hold openings will be seen to provide relatively wide and smooth radius for the hands, thus eliminating any rough or harsh edges on a user's hands.

The remainder of the shipping or packing container 10 is easily disassembled by breaking loose the adhesive joint between the adhesive tab 54 and the outer edge 60 of the rear panel 18, and everting the container 10 by reversing the steps described above for the assembly of the container 10 for use as a shipping container. As the adhesive joint between the adhesive tab 54 and the outer edge 60 is formed on the first surface 12, which first surface 12 is everted to form the inside surface of the container 10 in its second state for secondary use e. g. as a recycling container, it will be seen that any surface damage to the outer edge 60 of the rear panel 18 is concealed on the inside of the container 10 after it is reassembled in its everted second state. The release sheet 64 is removed from the second adhesive strip along the adhesive tab 54, and is used to reseal the adhesive tab 54 to the opposite edge 60 of the rear panel 18. While the adhesive tab 54 was originally sealed to the outer first surface of the container 10 in its first state as a shipping container, it will be seen that when the container 10 is everted that the adhesive tab 54 will be to the inside of the container 10 when it is resealed to the same edge 60 as originally attached. This serves to simplify the initial manufacture of the present invention, as the two parallel adhesive strips 54 and 62 are applied to the same surface 14 of the blank 10*a*, and also conceals the tab 54 within the container 10 ion its second, everted state with the second surface 14 displayed as the outer surface.

The present container 10 thus may serve a variety of uses, but is particularly suited for use as a container for recyclable products. The openings in the lid 32 or 32*a* provided by the removal of the perforated areas 84, 86 or 84*a*, 86*a* provided for ease of insertion of flat, planar articles (e. g., the removed secondary lid 78 of the present invention, papers, etc.) or bulkier articles (e. g., cans, bottles, etc.) without need to open the lid 32/32*a*. When the container 10 is full, it may be removed and carried to a disposal site by means of the hand hold openings 80 and 82 provided by the inward folding of those perforated areas, the lid 32/32*a* hingedly opened along the lid/rear panel fold line 48, and the contents emptied for recycling or other purpose, The container 10 may itself be reused numerous times and may be stored in a visible place in the home or other area as needed, due to the provision for an attractive or interesting surface finish on the second surface 14 of the container 10, which surface 14 is the outer surface when the container 10 has been everted and reassembled as described above. The present invention provides a means for companies wishing to put forth an image of environmental concern, to accomplish such by using the present invention as a reusable shipping container, particularly when the container 10 is formed of recycled materials. The second surface provides for the placement of an attractive or decorative design(s) thereon, and/or advertising messages which may be used to defer the cost of production and purchase of the containers by a company, thus lowering the shipping cost to the consumer. Also, instructions for the everting and reuse of the container 10 may be printed on the second surface 14 of the container 10, thus encouraging its further use rather than merely being discarded and adding further to the disposable waste produced by our society.

It is to be understood that the present invention is not limited to the sole embodiment described above, but encompasses any and all embodiments within the scope of the following claims.

I claim:

1. A reversible container having a first surface and an opposite second surface and including means providing for the everting of said reversible container from a first state wherein said first surface comprises the outer surface comprises the outer surface of said reversible container, to an everted second state wherein said second surface comprises said outer surface of said reversible container, comprising:

a front panel and an opposite rear panel connected by first and second side panels, with an adhesive tab extending from said first side panel and securable to said rear panel;

said adhesive tab providing first means for closure of said reversible container in said first state and second means for the everted closure of said reversible container in said second state to form a substantially rectangular structure;

said first and second means for closure of said reversible container respectively comprise a first layer of adhesive material disposed upon said adhesive tab second surface and a second layer of adhesive material disposed upon said adhesive tab second surface and having a release sheet releasably installed thereover, with said second layer of adhesive material being substantially parallel to said first layer of adhesive material; and top and bottom closure means providing for the complete closure of said reversible container, whereby;

said reversible container is closed with said first surface outward and sealed by said first closure means on said first surface, and then opened and everted to place said second surface outward and resealed by said second closure means on said first surface.

2. The reversible container of claim 1 wherein:

said reversible container is formed of a single sheet of material.

3. The reversible container of claim 1 wherein:

said top closure means comprises an openable lid having a front lid edge and first and second lid side edges;

said lid including means providing for the everting of said lid from said first state of said reversible container to said second state of said reversible container.

4. The reversible container of claim 3 wherein:

said lid is hingedly attached to said rear panel.

5. The reversible container of claim 1 including:

means providing for access openings in said lid and further means providing for hand hold openings in said first and second side panels of said reversible container.

6. The reversible container of claim 5 wherein:

said means providing for access openings comprises an elongated slot and a substantially circular central opening, with said slot and said central opening being mutually concentric.

7. The reversible container of claim 5 wherein:

said access opening means comprises an elongated slot and a separate substantially circular opening.

8. The reversible container of claim 1 including:

means providing for access openings in said: lid and further means precluding the premature opening of said access openings in said lid, with said means precluding the premature opening of said access openings in said lid comprising;

said front panel having an upper edge with said upper edge having a secondary panel extending therefrom, whereby;

said secondary panel is foldable within said reversible container to lie immediately beneath said lid when said complete closure of said reversible container has been accomplished, thereby precluding premature removal of said means providing for access opening in said lid and the removal of any contents of said reversible container therefrom.

9. The reversible container of claim 1 including:

fold lines formed between at least each of said panels and said top and bottom closure means, with said fold lines including scores and intermittent perforations therealong to provide for ease of folding.

10. The reversible container of claim 1 wherein:

said reversible container is formed of recycled materials.

11. The reversible container of claim 1 wherein:

said reversible container is formed of fiberboard.

12. The reversible container of claim 1 wherein:

said reversible container is formed of corrugate fiberboard.

13. The reversible container of claim 1 wherein:

said reversible container is formed of synthetic sheet materials.

14. The reversible container of claim 1 wherein:

said reversible container is formed of plastic sheet material.

15. The reversible container of claim 1 wherein:

said second surface includes a finish providing for the imprinting of indicia thereon.

* * * * *